United States Patent [19]

Brodie

[11] Patent Number: 4,798,138

[45] Date of Patent: Jan. 17, 1989

[54] LIQUID DISTRIBUTION SYSTEM

[76] Inventor: George R. Brodie, 1015 N. Alexander St., Mt. Dora, Fla. 32757

[21] Appl. No.: 142,994

[22] Filed: Jan. 12, 1988

[51] Int. Cl.[4] ..... B41F 31/12

[52] U.S. Cl. ..... 101/365; 118/262

[58] Field of Search ..... 101/365, 350, 349, 148; 118/262

[56] References Cited

U.S. PATENT DOCUMENTS

| | | | |
|---|---|---|---|
| 3,037,449 | 6/1962 | Aller | 101/350 |
| 3,261,287 | 7/1966 | Brodie | 101/350 |
| 4,402,263 | 9/1983 | Honkawa | 101/350 |
| 4,404,909 | 9/1983 | Fischer | 101/350 |
| 4,467,720 | 8/1984 | Gertsch | 101/348 |
| 4,559,874 | 12/1985 | Schuhmann et al. | 101/350 |
| 4,577,557 | 3/1986 | Fischer | 101/217 |
| 4,682,543 | 7/1987 | Witczak et al. | 101/350 |

*Primary Examiner*—Clifford D. Crowder

[57] ABSTRACT

An improved ductorless liquid distribution system utilizes a plurality of side-by-side mounted radially-compressible roller elements to transfer ink from a reservoir immersed fountain roll in the form of sinusoidal bands onto a longitudinally vibrating distribution roll. The pressure of the roller elements against the fountain and distribution rolls is individually adjustable to control the deformation of the rollers and thus the width of the bands. The distribution roll vibrates an amount equal to the longitudinal spacing between rollers to provide complete inking coverage and the rolls and rollers are relatively dimensioned to obtain the crisscrossing of successive sinusoidal bands and smoothing out thereof by the addition of other vibrating rolls. In a described embodiment for high speed printing presses, the need for a keyed blade and an oscillating ductor is eliminated.

20 Claims, 3 Drawing Sheets

FIG. 2
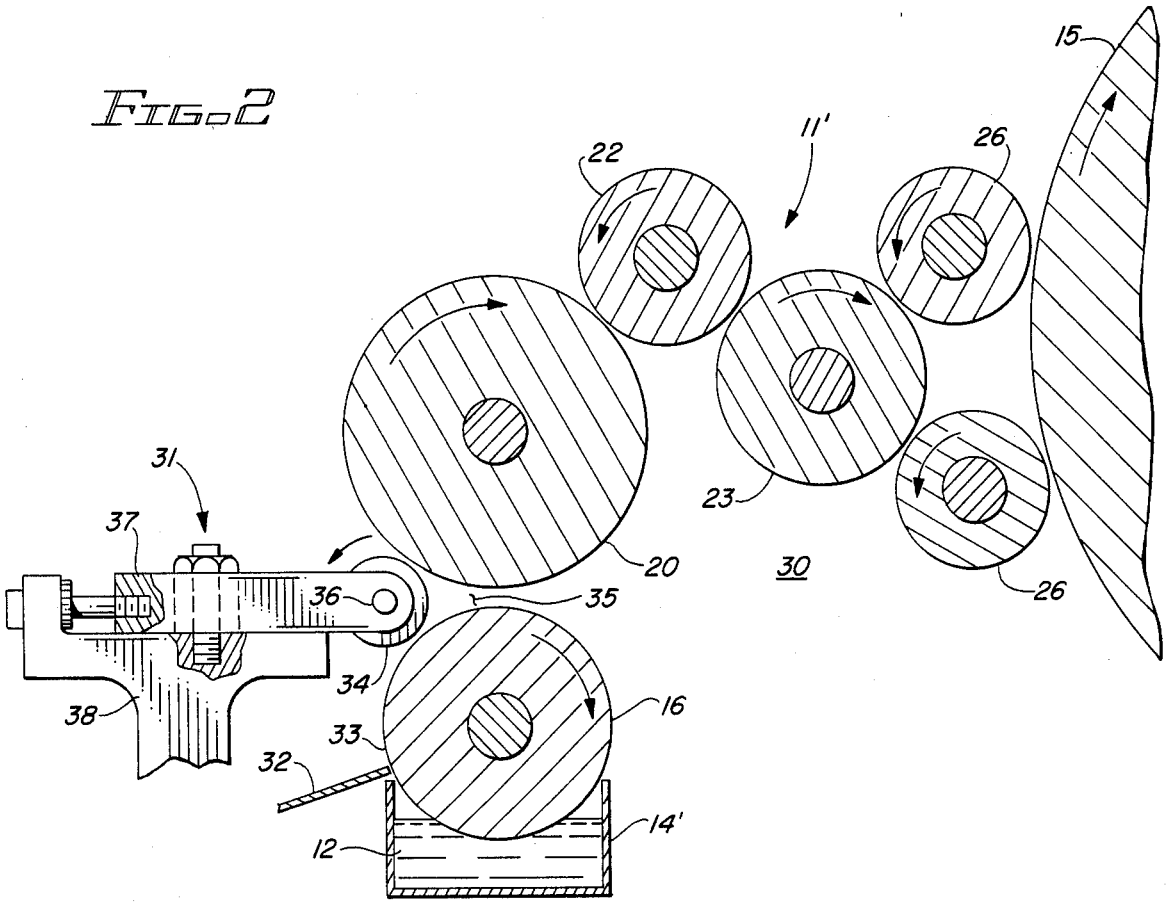
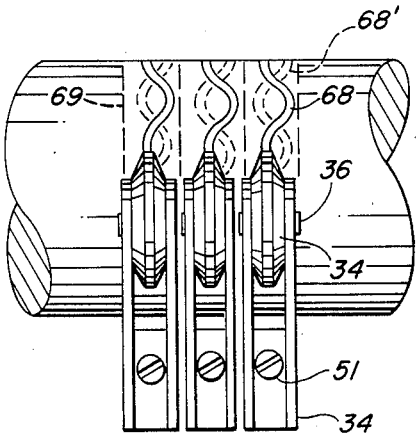
FIG. 6
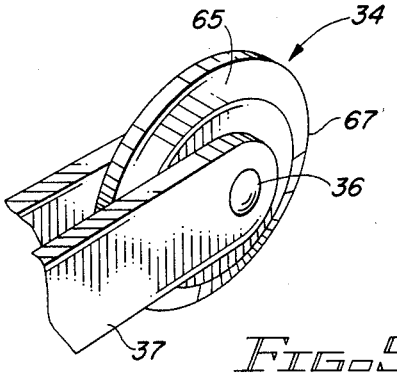
FIG. 5

LIQUID DISTRIBUTION SYSTEM

This invention relates to an improved ductorless liquid distribution system which utilizes a train of distribution rolls to apply a thin film or coating of liquid in a controlled manner onto a receiving surface.

BACKGROUND OF THE INVENTION

As used herein, "liquid" is intended to include all materials susceptible of being spread, smoothed out and conveyed by rolls, such as semi-liquids, pastes, oily masses and the like.

Printing and various other processes involving the deposition of a thin film of liquid in a controlled manner from a supply reservoir onto a receiving surface often employ a liquid distribution system which utilizes a train of distribution rolls for workng and rolling out the liquid in a controlled manner to provide a uniform film having desired characteristics. In publication printing, for example, the thickness of the print on one side of a printed page is on the order of 0.0002 in., or so. The extreme thinness of the ink film to be produced requires considerable care in inker design and operation.

In a typical such process, a slowly rotating fountain roll, partially immersed in a liquid reservoir, is used to initially pick up an amount of the liquid from the reservoir. The liquid is then transferred from the fountain roll onto a succession of high speed rotating distribution rolls which serve to spread it out before applying it to the receiving surface. Because of the difference in speeds between the slow fountain roll and the fast distribution rolls, such systems usually require some sort of transfer means other than direct contact between the fountain roll and the first distribution roll.

One form of transfer means frequently used is a freely rotating ductor roll which is positioned in a gap between laterally-spaced parallel fountain and first distribution rolls, and which shifts back and forth between a position of roller contact with the fountain roll and a position of roller contact with the first distribution roll. In a typical arrangement, the ductor turns first several times in contact with the fountain roll picking up a layer of liquid therefrom, then shifts into contact with the first distribution roll for several rotations, depositing the liquid in a mat thereon before shifting back to the fountain roll. Because of its intermittent action and smaller outside diameter, the ductor brings up mats of liquid in successive waves longitudinally across the first distribution roll. Such mats are then spread out and overlapped into a uniform film as they are passed from distribution roll to distribution roll. The distribution procedure is enhanced by providing counterrotating rolls of different diameters and by vibrating some of the rolls longitudinally relative to the others. The train of distribution rolls is organized so that the last distribution roll or rolls (called the "form" rolls in printing) will transfer a film of the liquid of desired thickness and uniformity onto an ultimate receiving surface, such as the surface of a printing plate cylinder or drum. Control over pick-up of liquid onto the fountain roll, and therefore over the deposited film, is afforded among other things by varying the speed of rotation of the fountain roll.

The use of such ductor rolls has many disadvantages. The intermittent transfer of liquid in a ductor system complicates the liquid distribution process. A ductor may spend one-third of its time picking up ink from the fountain roll, one-third of its time delivering ink to the distribution roll, and one-third of its time travelling from one roll to the other. Thus, for every cycle of the ductor, there is a lapse in the ink feed which must be compensated for by depositing a heavier film on the distribution roll which must be levelled out to cover the gaps. Moreover, liquid is transferred by the ductor in wedge-shaped patches of nonuniform thickness. More liquid is transferred when the ductor traveling at the slower fountain roll speed first contacts the distribution roll, than after it adjusts to the higher distribution roll speed.

Because of the way the ductor transfers liquid from the fountain to the distribution train in mats, a large number of rollers is needed to smooth and spread the liquid into the desired film uniformity and thickness. The liquid must be kept at the right consistency and be prevented from evaporating excessively over such long distribution paths. This is particularly important in printing, where the ink has to be kept from drying before it reaches the plate. Evaporation of ink solvents over such long inking paths is also a problem from an environmental standpoint, because of the adverse effect of the vapors on the Earth's ozone layer that provides protection against the harmful effects of the sun's radiation. In high speed presses, shifting a large heavy ductor back and forth between a fountain roll turning at, say, 800 ft. per min. and a first distribution roll rotating at, say, 2,000 ft. per min., expends much energy and generates considerable heat. Heat not only increases evaporation but also affects the viscosity of the distributed liquid. The use of expensive specially formulated, high boiling point narrow range solvents is thus necessitated.

The drying process in high speed printing is also complicated by the use of a ductor distribution system. As the mats of ink are transferred from roll to roll, there is nonuniform exposure of the ink solvents to air and spotty areas of higher retained solvent content remain after printing. This nonuniformity, as well as the general requirement for higher solvent boiling points, necessitates the use of higher velocity air blasts and more heat in the dryer. Increased air velocity or other measures must consequently be taken during drying to prevent browning of the printing medium, especially when the press stops. Also, since the printing medium is heated to a greater extent, the cooling step will require greater cooling.

Conventional liquid distribution systems of the type to which the present invention relates, especially those involving high viscosity liquids such as printing inks, will typically further control the transfer of liquid from the reservoir to the fountain roll by means, such as a flexible blade, extending longitudinally across the fountain and means for selectively adjusting the spacing of the blade from the fountain roll to provide predetermined varying degrees of liquid pick-up longitudinally across the roll. In a typical present day high speed printing press inker arrangement, for example, a blade is positioned adjacent where the fountain roll emerges from the fountain, with the blade forming an extension of the bottom of the fountain. Normal spacing of the blade from the fountain may be about 0.015 in., with keys being provided at spaced intervals of about 1¼ in. longitudinally of the blade to enable local adjustment of the spacing. Closer spacing of the blade reduces the ink coating picked up and carried by the fountain roll at a particular point; wider spacing increases the thickness.

The keys are individually adjusted as needed to provide the required thickness and uniformity of the deposited liquid film at the receiving surface. On high speed presses, some keys are adjusted to bring the blade into close abutment with the fountain roller, to thereby prevent the inking of certain locations of the receiving surface, such as those corresponding to the margins of the pages to be printed.

The action of the blade in controlling the liquid transfer to the fountain roller serves as another source of heat generation in the liquid distribution system. This is especially true where the keys are adjusted locally to inhibit any ink pick-up. Local variations in heat generation lead to undesirable local variations in liquid viscosity for which compensation at the receiving surface is difficult. Overall and local heat generation also causes thermal expansion of the blade which changes the distance of the blade from the fountain roller, requiring frequent key readjustment. Changes in gap of 0.001 in. due to heating are not unusual. Local variations in heating and keying can also have temporary and permanent distorting effects on the blade which interfere with the liquid film thickness control.

The blade is usually of tempered steel. Pressure of the blade against the fountain roll can also cause the roll itself to deflect. Fountain roll deflection will affect the thickness settings across the roll in unpredictable ways, changing the effect of other key settings. Reducing the gap between the blade and the roll at one location may, for example, because of deflection of the roll, cause completely unwanted liquid flow changes at adjacent key locations.

Prior art liquid distribution systems also have the disadvantage of providing a return path from the receiving service to the reservoir for the passage of dust, dirt, old liquids and similar undesirable substances which contaminate the fresh liquid supply. In printing systems, for example, paper lint, stale solvents and other dirt from the plate may work their way back to the ink fountain where they contaminate and change the character of the ink. This is apparent when the ink loses its translucent quality and becomes darker. Although printing may still be possible, the thickness of the film on the plate may have to be increased significantly because the impurities have no color value. This is accomplished by speeding up the fountain roll, moving the fountain blade outward, or both. The accumulation in the fountain of paper debris that works its way back through the ductor can be a formidable problem, requiring constant attention. Debris accumulation in the fountain of a high speed press may approach one-third the volume of the ink reservoir after just a few hours of press run time.

Various proposals have been made to address the problems of conventional ductor liquid distribution systems. To reduce the inertial effect and wear in the shifting of the ductor roller back and forth between the fountain roll and the first distribution roll, the ductor roll has been configured with a plurality of eccentric ring sections, so that some of the ring sections are in contact with the fountain roll while others are in contact with the distribution roll. Examples of such eccentric section ductor arrangements are shown in U.S. Pat. Nos. 3,037,449 and 4,467,720. In such arrangements, although the overall ductor roll remains in contact at all times with both the fountain roll and the distribution roll, individual roller sections of the ductor shift their contact between the two rolls.

My U.S. Pat. No. 3,261,287 follows a different approach and proposes a ductorless distribution system that transfers liquid between a slow speed fountain roll and a high speed distribution roll by means of spherical steel balls supported side-by-side by downwardly directed guides for free rotation in the space between the rolls. The balls all remain in contact with both rolls at all times. The balls act to bring up narrow lines of liquid from the fountain roll to the distribution roll. Relative longitudinal vibration between the ball guides and the distribution roll causes the liquid lines to be deposited on the distribution roll in the form of crisscrossing sinusoidal lines.

My U.S. Pat. No. 3,261,287 ductorless arrangement, which lays the ink down in lines rather than in mats as in conventional systems, permits the deposited liquid to be spread out and worked into a substantially uniform film of desired thickness with a much reduced number of rolls. There is also significant reduction in the debris returning from the receiving surface back to the reservoir. Ink thickness control of the '287 arrangement uses a key and blade setup, as discussed above. However, for locations where the complete absence of liquid is desired, balls may be removed and spaces left, thereby eliminating the need to key the blade into closed gap configuration at such locations.

The present invention builds upon the experience gained in developing my U.S. Pat. No. 3,261,287 arrangement, and provides an improved ductorless liquid distribution system that offers all the advantages of my U.S. Pat. No. 3,261,287 system over conventional ductor systems and offers additional advantages as well.

SUMMARY OF THE INVENTION

It is an object of the present invention to provide an improved liquid distribution system for applying a thin film or coating of liquid in a controlled manner from a liquid reservoir onto a receiving surface utilizing a distribution roll train, without employing either a ductor roll or a key blade adjustment.

It is another object of the present invention to provide an improved ductorless liquid distribution system that utilizes a plurality of thin roller elements having radially-compressible resilient peripheral outer surfaces to transfer liquid in controlled bands from a first low speed rotating roll to a second high speed rotating roll, to thereby apply a thin film or coating of liquid in a controlled manner from a liquid reservoir onto a receiving surface.

The liquid distribution system of the present invention offers the following and other advantages over the conventional ductor roller systems described above: The liquid is transferred from the fountain roll to the first distribution roll in uniform, continuous bands of liquid whose width and placement on the circumference of the distribution roll can be better controlled than the mats laid down in conventional systems. The liquid transfer roller elements are all in contact with both the fountain roll and the distribution roll at all times, so do not have the shifting and associated inertia and heat problems of conventional ductor rolls. The roller arrangement of the invention minimizes the return path for contaminants to travel from the receiving surface back to the reservoir, therefore maintaining the freshness of the liquid supply longer. The local thickness of the liquid at positions longitudinally of the rolls can be controlled by varying the pressure with which the roller elements are placed in contact with the fountain and distribution rollers, thereby varying the width of the transferred liquid bands and eliminating the need for local adjustments of a fountain blade, with corresponding reduction of blade induced heat and thickness variations due to blade distortion. Contact between individual roller elements and the rolls can be eliminated altogether at positions corresponding to positions on the receiving surface at which no liquid is desired. The method of transfer of the liquid with attendant smoothing and spreading is accomplished in a much shorter path with very few rolls and less heat generation and evaporation, as a consequence of which faster drying, lower boiling point liquids can be used. The continuous nature of the transfer and the shorter path distance from fountain to deposition surface greatly facilitates start up and stopping, which for printing processes can lead to significant savings on wasted paper during color changes, etc.

A liquid distribution system in accordance with the invention applied to a high speed printing press is discussed in greater detail below, in which a plurality of thin roller elements having radially-compressible resilient peripheral outer surfaces are pressed against adjacently positioned fountain and distribution rolls to controllably transfer ink from one to the other. The control of ink across the press plate cylinder is accomplished by selectively varying the pressue of application of individual ones of the roller elements, thereby eliminating the requirement for adjusting individual keys across the fountain blade. An inking system in accordance with the embodiment described makes possible the use of lower boiling point ink solvents, and also the use of a lower percentage of solvent to other ink components.

BRIEF DESCRIPTION OF THE DRAWINGS

Embodiments of the invention have been chosen for purposes of illustration and description, and are shown and compared with an exemplary prior art system in the accompanying drawings, wherein:

FIG. 2 is a figure corresponding to that of FIG. 1 of a liquid distribution system in the form of an ink distributing apparatus for a printing press in accordance with the present invention;

FIG. 5 is a fragmentary perspective view of one of the roller elements of the liquid transfer assembly of FIGS. 3 and 4; and FIG. 6 is a schematic view useful in understanding the operation of the liquid transfer assembly of FIGS. 2–5.

Throughout the drawings, like elements are referred to by like numerals.

DESCRIPTION OF THE PREFERRED EMBODIMENTS

The improved ductorless liquid distribution system of the present invention is described as applied to an embodiment of a printer press ink distribution system which transfers a quantity of printing ink or similar liquid from a supply reservoir onto a receiving surface such as a plate cylinder for printing. For understanding the advantages and benefits of the present invention, it is considered useful to contrast the distribution system of the invention with a typical arrangement currently in commerical use.

Figure 1:
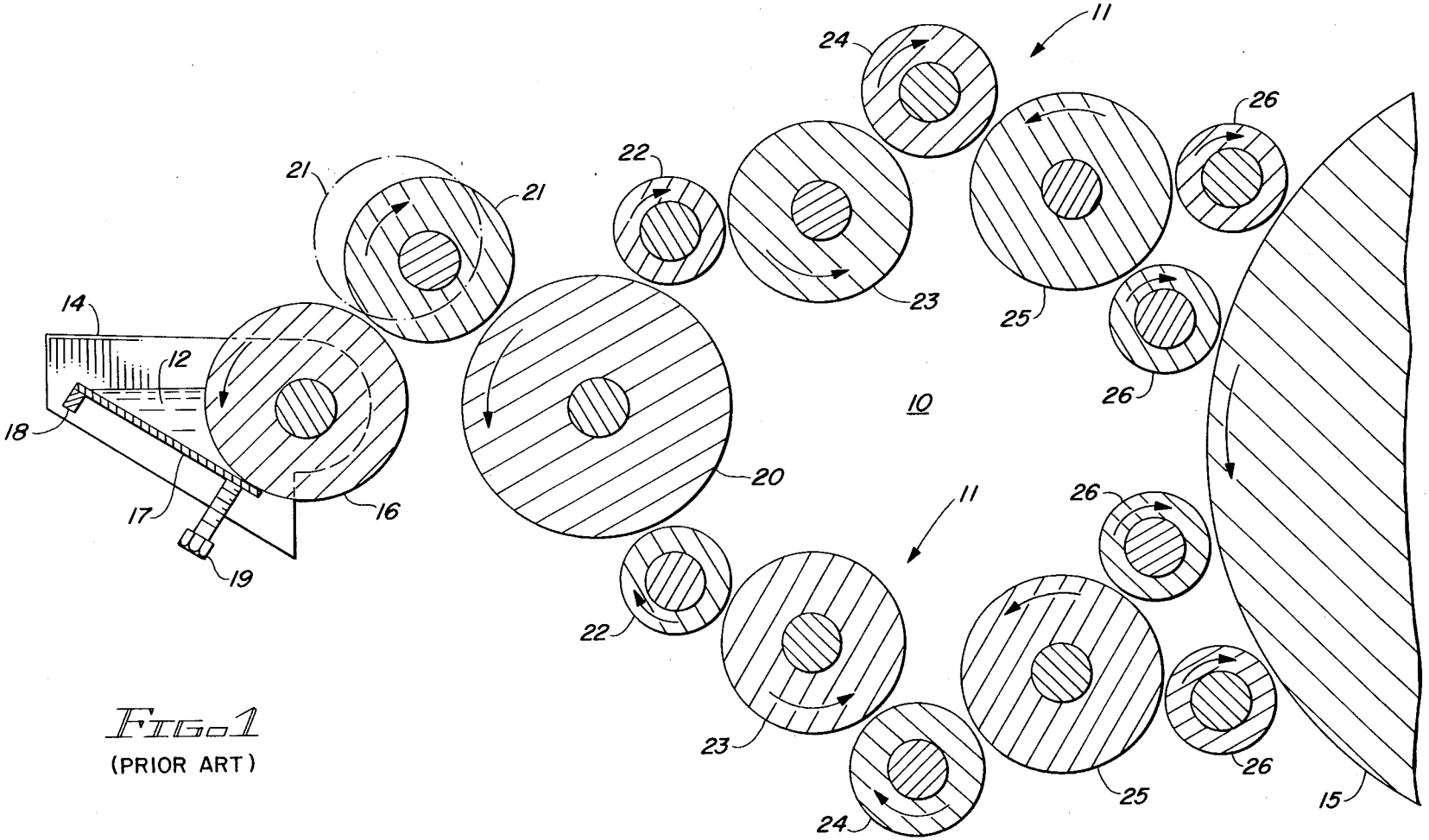
FIG. 1 (PRIOR ART)
FIG. 1 (prior art) is a view in section taken transversely through a portion of a liquid distribution system in the form of a conventional ink distributing apparatus for a printing press.

As shown in FIG. 1 (prior art), a conventional liquid distribution system 10 utilizes one or more trains 11 of parallely mounted distribution rolls to transfer a quantity of liquid ink 12 from an ink fountain 14 in a controlled manner onto the surface of a plate cylinder 15. As a first step in the distribution process, ink is deposited onto a fountain roll 16 which is disposed to define a front wall of the liquid reservoir and which slowly rotates in the direction indicated.

A flexible blade 17, supported at a downwardly forward sloping angle by a bracket 18 to extend longitudinally across the rear of the roll 16, defines the bottom of a pocket within which the ink supply is contained. Normal spacing of the blade 17 from the fountain roll 16 is about 3/16 in. Keys, in the form of adjustment screws 19, are provided at about 1¼ in. intervals longitudinally of the blade 17 to enable adjustment of the blade spacing. The amount of ink coating picked up by the roll 16 as it turns is controlled by its speed of rotation and by the spacing between the blade 17 and the roll 16. Closer spacing of the blade 17 reduces the ink coating picked up and carried by the fountain roll 16; wider spacing increases the coating.

Ink taken up by the roll 16 is then transferred successively for spreading out to a multiplicity of counterrotating, high speed distribution rolls of different diameters, at least some of which are mounted for longitudinal vibration relative to adjacent rolls. Transfer from the slow moving fountain roll 16 to the first distribution roll 20 is accomplished in typical fashion by means of a ductor roll 21 which is oscillated back and forth between contact with the fountain roll 16 and contact with the first distribution roll 20. The ductor roll 21 is freely rotatable and is positioned to first rotate with the fountain roll 16 for a set number of revolutions (dot-and-dash line position in FIG. 1) and is then shifted to a position for rotation with the first roll 20 for a set number of revolutions (solid line position in FIG. 1), to bring ink up in successive mats onto the first roll 20. The cyclic duration of contact of the ductor roll 21 respectively with the fountain roll 16 and the first roll 20 can be varied in conjunction with the speed of rotation of roll 16 and the opening at the nip between blade 17 and roll 16 to provide additional adjustment of the amount of ink transferred between ink reservoir 14 and the first distribution roll 20.

Ink deposited by the ductor 21 onto the first high speed roll 20 is then spread and smoothed by successive transfers from one subsequent distribution roll to another. In the typical conventional arrangement shown in FIG. 1, two trains 11 of counterrotating rolls serve to achieve the required thickness and uniformity for deposition of the desired thin film of liquid 12 onto the surface of the plate cylinder 15. As shown, ink laid out on roll 21 is picked up by counterrotating roll 22 and deposited onto roll 23. Ink from roll 23 is then picked up by roll 24 and deposited onto counterrotating roll 25. Finally, the ink spread over roll 25 is transferred to form rolls 26 which deliver the ink to the plate 15.

The various rolls in the distribution train are parallely mounted in contact with each other and are of varying diameters, with rolls 20, 23 and 25, for example, being longitudinally oscillating to give the desired ink spreading effect. In accordance with conventional teachings, the first roll 20, and alternating rolls 23 and 25 thereafter, usually have a hard steel, smooth outersurface.

Intermediate rolls 22, 24 and 26 are longitudinally stationary rotatable rubber rolls. Additional vibratory and stationary rolls, sufficient to give the required distribution, will be included within the roll trains 11 between the first roll 20 and the form rolls 26. It is not unusual for conventional roll trains 11 to have as many as twelve or more distribution rolls in them. Ink deposited on the plate cylinder 15 by the form rolls 26 will then either directly, or indirectly such as by means of a blanket cylinder in an offset process, be transferred onto paper or other printing medium set over an impression cylinder (not shown).

FIG. 2 illustrates an improved ductorless liquid distribution system 30 in accordance with the present invention that has marked advantages over the conventional distribution system 10 of FIG. 1. In particular, the provision of novel ductorless means 31 for transferring liquid between the slow speed fountain roll 16 and the first high speed distribution roll 20 eliminates the need for a keyed fountain blade 17 and significantly reduces the number and area of distribution rolls needed in the train between the first roll 20 and the form rolls 26 to deliver a uniform liquid film to the plate cylinder 15.

A comparison of the novel system 30 of FIG. 2 with the prior art system 10 of FIG. 1 shows a similar arrangement of fountain roll 16 partially immersed for slow rotation into a supply of liquid ink 12. The ink fountain 14' of FIG. 2 is, however, different from the ink fountain 14 of FIG. 1 in the simplicity permitted in its configuration. While the ink 12 in FIG. 1 was contained within a pocket whose front wall was constituted by the roll 16 and whose bottom was constituted by the angled blade 17, it is sufficient as shown in FIG. 2 for the reservoir 14' in the novel system 30 to be an open-topped rectangular container of ordinary U-shaped cross-section with the fountain roll 16 mounted above it, so that a lower portion of its outer cylindrical surface travels below the standing level of the ink 12. No adjustable nip like that between the blade 17 and roll 16 of FIG. 1 is needed—variations in the thickness of ink deposition across the length of the first roll 20 being subject to control by the novel liquid transfer means 31, as will become more apparent. A simple leveling blade 32 spaced transversely by a uniform gap 33 longitudinally across the fountain roll 16 (FIG. 2) serves optionally to keep the amount of ink picked up in the fountain 14' by the roll 16 from becoming too thick, thereby assuring that fresh ink is being brought up.

As in the conventional arrangement of FIG. 1, a train 11' of high speed, counterrotating, vibratory distribution rolls 20, 22, 23 and form rolls 26 is provided in system 30 for spreading and smoothing the ink deposited on the first roll 20 from the fountain roll 16 to ensure a uniform layer of ink before application to the plate 15. However, because of the advantageous operation of the ductorless liquid transfer means 31 of the invention, fewer distribution rolls are required in the arrangement 30 of FIG. 2 than are needed in the inking system 10 of FIG. 1. While conventional systems may utilize twelve or more distribution rolls, ink spreading in accordance with the invention may be accomplished with as few as only a half dozen rolls.

Figure 3:
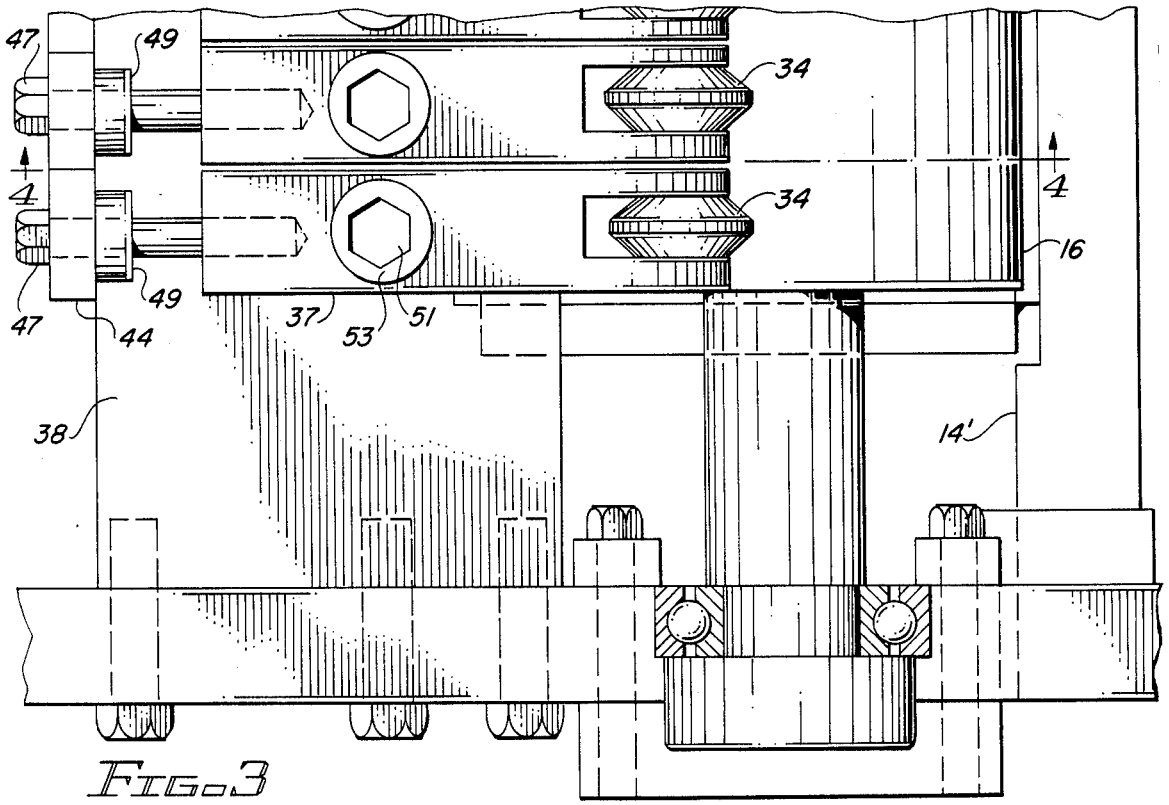
FIG. 3 is a fragmentary top plan view of a liquid transfer assembly of the system of FIG. 2.
Figure 4:
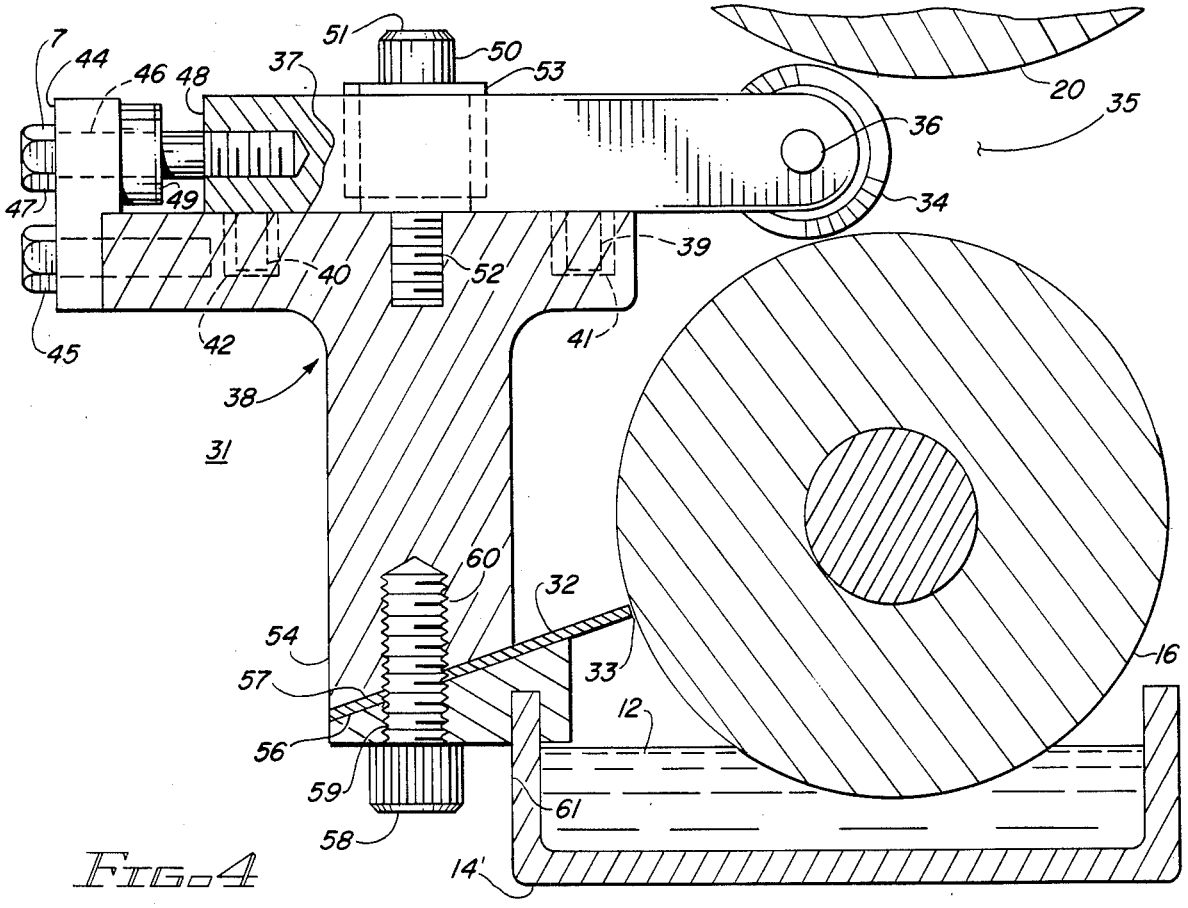
FIG. 4 is a section view taken along the line 4—4 of FIG. 3.

As shown in FIGS. 2–4, ink is transferred from fountain roll 16 to laterally spaced parallely disposed first roll 20 by means of a plurality of thin roller elements 34 spaced at intervals across the length of the gap 35 between rolls 16 and 20, with their axes of rotation parallel to the axes of rotation of rolls 16 and 20.

Each element 34 is separately mounted for free rotation about a pin 36 extending through the element 34 between parallely extending furcations at the projecting end of an elongated arm 37 (see FIG. 3). The respective arms 37 are parallely positioned in side-by-side relationship across an upper horizontal surface of a "T" cross-sectioned support 38 (see FIG. 4) that extends longitudinally adjacent the full length of the gap 35. The other end of each arm 37 is attached atop support 38 for individual, selective adjustment of the extent of projection of each element 34 into the gap 35 and into contact with the rolls 16 and 20.

In the exemplary arrangement of FIGS. 3 and 4, each arm 37 has two depending, axially-spaced locating lugs 39, 40 that fit within corresponding guide channels 41, 42 recessed in the top surface of the support member 38.

The channels 41, 42 are elongated normal to the longitudinal axis of support 38 and dimensioned relative to the lugs 39, 40, so that when the lugs 39, 40 are respectively fitted within the channels 41, 42 the corresponding arm 37 is constrained against lateral movement but has some freedom for positional adjustment perpendicular to the longitudinal axis of support 38. A bracket 44 extends upwardly at the top rear of the support 38 at each arm 37 location. Each bracket 44 is suitably fastened as by a bolt 45 to the support 38, and includes in a vertically upwardly extending portion behind each arm 37 a bore 46 axially aligned with the arm 37. An adjustment bolt 47 extends through the bore 46 for threaded interengagement with a complementary axial bore 48 in the rear, non-bifurcated end of each arm 37. The bolts 47 serve to horizontally position the respective arms 37, and thus the elements 34, into and out of the nip 35 between the rolls 16 and 20, for liquid transfer control purposes as more fully detailed below. A collar 49 brought against the front face of the bracket 44 and held by a roll pin on the arm 37 side of the bore 48 serves to hold the bolt 47 snuggly within the bore 44, while allowing rotation for the desired horizontal positioning of the arm 37.

To maintain the vertical positioning of the arms 37, each arm 37 is provided with an axially elongated bore 50 through which a bolt 51 passes for threaded interengagement with a threaded bore 52 extending into a vertically depending portion of the support 38. The bolt 51 is fastened down onto a washer 53 against the top of the arm 37 to lock the arm 37 against the upper surface of the support 38 after horizontal alignment is achieved. The axial elongation of the bore 50 in arm 37 serves to permit bolt 51 to pass through the arm 37 for a range of horizontal positionings.

The support assembly 38 can be utilized to both adjustably support the roller elements 34 and to support the optional leveling blade 32. As shown in FIG. 4, the lower end 54 of the vertical portion of the support 38 is angled forwardly and upwardly along its length to accommodate the leveling blade 32 in angled position between the end 54 and a similarly angled keeper member 56. The blade 32 can be provided with elongated apertures 57 at intervals across its length. Upwardly directed bolts 58 can be received through the blade apertures 57 into aligned bores 59 and 60 located at matching intervals in the keeper 56 and lower end 54 to maintain positioning of the blade 32 relative to the roll 16. The elongations of the apertures 57 are normal to the length of the keeper 56 and are dimensioned to allow the desired range of adjustment of the gap 33 between the blade 32 and the roll 16. It is noted that provision for local differences in gap 33 adjustment across the length of the blade 32 is not necessary, since a uniform gap is sufficient for the leveling function, the requirement for extensive blade keying being eliminated by the novel liquid transfer means of the invention.

The bottom surface of the keeper member 56 is shown in FIG. 4 as provided with a longitudinal groove 61 into which the rim of one of the long sides of the simplified container of the fountain 14 can be received as an aid to alignment and positioning.

As seen in FIG. 5, each roller element 34 suitably takes the form of a bevelled disk of composite construction having a supporting core 65, and an annular peripheral and outer surface 67. The core 65 is chosen of a material suitable for rotating about the pin 36. The outer surface 67 is chosen as a working surface of radially-compressible, resilient material. In a preferred embodiment, the core 65 is of a material such as nylon having a durometer hardness of about 80 (+ or −10), and the outer surface is of a softer material such as polyurethane with a durometer hardness of about 15 (+ or −5). It will be appreciated that the elements 34 may be chosen of integral rather than composite construction, and that it is not so much the choice of a particular material that is important, but the choice of a material that will suitably serve to perform the described liquid transfer function.

The elements 34 are freely rotatable about the pins 36 (FIG. 5) of the arms 37 so that when they are brought into simultaneous contact with the different rotational speeds of the fountain and first rolls 16 and 20, they will be caused to rotate at some intermediate speed. Ink raised up onto the cylindrical outer surface of the fountain roll 16 from the ink supply 12 of the reservoir 14' will be picked up continuously by the outer surfaces of the elements 34 and delivered in bands 68 onto the cylindrical outer surface of the first distribution roll 20. Longitudinal vibration of the roll 20 causes the bands 68 to undulate sinusoidally in serpentine fashion. The relative diameters of the elements 34 and the roll 20 are preferably chosen such that the successive bands 68, 68' of ink laid down on roll 20 by the elements 34 will crisscross as illustrated in FIG. 6, to provide for greater liquid distribution. After only a few revolutions of roll 20, the successively laid down bands 68, 68' become a continuous linear track 69, as indicated by dashed lines in FIG. 6.

The side-by-side array of narrow elements 34 extends across the length of the rolls 16 and 20. The pressure exerted by each element 34 against the rolls 16 and 20 is selectively set by inward or outward movement of the corresponding arm 37. As pressure of an element 34 is increased against the rolls, the soft outer surface 67 deforms to increase the width of the ink band 68 deposited onto the roll 20 by that element. As pressure is relaxed, the width of the band 68 laid down by an individual element 34 is decreased. The elements 34 are set at intervals longitudinally of the rolls 16 and 20 so that the totality of interwoven bands 68 and tracks 69 brought up onto the roll 20 takes the form of a solid and continuous layer of deposited ink. The tracks 69 are then further filled in and expanded longitudinally by the spreading and smoothing action of successive counter-rotating, reciprocating rolls 22 and 23 of different diameters (see FIG. 2), the ink being applied on each successive roll in a solid layer of less thickness, before being applied by the form rolls 26 to the plate cylinder 15. The result is that the ink from the single bands 68 is rapidly woven into a solid and continuous, thin layer of constant thickness. Such uniformity can be especially advantageous in obtaining a correct balance between ink and water in offset or lithography printing.

In a preferred embodiment, the elements 34 are spaced at 1¼ in. intervals across the width of the press and the first roll 20 is caused to reciprocate longitudinally for 1¼ in. The arms 37 are suitably set to cause the elements 34 to bring up ink bands of about 1/16 in. width. The individual pressures exerted by the respective elements 34 against the roll 20 can be adjusted by axial movement of the corresponding arms 37 so that the width of contact of the outer surfaces 67 with the roll 20 is increased as desired to vary the width of deposited bands 68 from 1/16 in. to ⅜ in. The lateral displacement of the bands as the roll 20 reciprocates will cause lateral displacement to fill in the deposited ink between each interval.

In contrast to the nonuniform intermittent application of ink mats in wedge-shaped patches by the ductor roll 21 in the prior art system 10, the bands 68 in the inventive system 30 are laid down by elements 34 in individually controllable, continuous and uniform manner. The liquid transfer means 31 of the present invention permits a substantial decrease in the number of distribution rolls required in the train. It is estimated that to achieve proper inking characteristics in high speed offset lithography, letter press or flexo-press printing, about five rolls per train would be sufficient. This is in sharp contrast to the perhaps fifteen such rolls which would be needed in conventional setups.

The decrease in the number of rolls provides a very short path (viz. about 24 in.) from ink supply to the plate. Thus, the transit time for the ink and solvent is much shorter and less evaporation will occur. Further, the sustained contact in system 30 between the elements 34 and both rolls 16 and 20, as compared to the oscillating contact of the ductor 21 (FIG. 1) with those rolls in the conventional system 10, will cause less heat generation and result in fewer mechanical ink transfer problems.

The transfer of ink from the fountain roll 16 to the first distribution roll 20 by way of individually controllable continuous bands 68 provides great versatility to processes such as those of large printing presses where longitudinal roll widths of 5–7 ft. are not uncommon. It is often desirable in such large systems to keep ink away from certain areas across the width of the plate. In the printing of multiple page magazine layout sheets, for example, ink may desirably be kept from marginal areas between pages, or from the spaces between columns of type. Such ink blocking was possible to some degree with the prior art arrangement of FIG. 1 by tightening the keys 19 to bring the fountain blade 17 into ink blocking contact with the fountain roll 16 at selected points across the width of the blade 17. Such a tight keying procedure, however, causes the generation of frictional heat and increases wear of the roll 16 and blade 17 at the closed gap locations. Because of the great number of rolls in conventional distribution trains and the nature of the mat spreading process, considerable run time may be taken up checking the results of blade keying to verify that the desired ink masking is established. Moreover, frequent key readjustment may be necessary since unpredictable localized mechanical and heat distortions of the blade may occur.

With the transfer means 31 of the present invention, the establishment of ink free areas on the plate cylinder 15 can be readily achieved by merely backing away selected ones of the elements 34 from contact with the rolls 16 and 20. Where ink free margins are to be established for repeated or lengthy runs on a particular press, it may be desirable to remove selected ones of the arms 37 completely from the support assembly 38. The spaces left by removal of those arms 37 will establish ready visual reference points across the press for operator adjustment as necessary of the remaining arms for setting the desired characteristics of the deposited layer for the areas left to be inked.

Transfer means 31 also provides considerable advantage over the ductor system 10 in savings on waste impressions during system start-up and stopping because of less ink accumulation in the system. In order to stop printing when using the continuous ink flow arrangement of the inventive system 30, the press operator merely shuts off the drive to the ink fountain roll 16, runs the press for about two or three more impressions, and then turns off the impression. Only a very thin outline (not enough to cause any trouble) of the form remains. To resume printing, the fountain roll drive is turned on, the operator lets the press turn over two or three times, then turns on the impression and starts printing.

With the prior art ductor system 10, printing three impressions after turning off the fountain roll 16 would still leave too much ink on the inker rolls. In a very short time, such ink would become tacky enough to pull the paper out of the press upon start-up. To prevent this, conventional procedure is to spray the inker rolls with about a pint of solvent. As a consequence, when the press is restarted, about 100 waste impressions (as compared with six waste impressions for the inventive system) have to be printed to use up and clear up the ink that was overloaded with solvent to permit the stop.

As is evident from the foregoing, the invention provides an improved ductorless liquid distribution system that utilizes fewer rollers and provides better ink layer control than conventional arrangements, without the necessity for complex blade keying operations. Ink transfer time from fountain to plate and system heat generation are greatly reduced, thereby permitting the use of lower cost solvents and inks and greatly simplifying the distribution operation.

Those skilled in the art will appreciate that the preferred embodiments of the invention described above are just examples of how the invention can be implemented, and that various substitutions and modifications may be made therein without departing from the spirit and scope of the invention as defined by the claims below.

What is claimed is:

1. Liquid distributing apparatus, comprising:

a reservoir containing liquid to be distributed;

a first rotatable roll having an outer surface and a portion immersed in the liquid in said reservoir for picking up a film of the liquid onto said outer surface;

a second rotatable roll having an outer surface and being spaced laterally from and disposed parallel to said first roll;

a plurality of thin roller elements having radially-compressible resilent outer surfaces;

means mounting said roller elements in side-by-side relationship in contact with the outer surfaces of both of said first and second rolls; and means for individually adjusting the position of each roller element relative to said first and second rolls to selectively set the contact pressure between the outer surface of each roller element and the outer surfaces of said rolls;

whereby ink brought up onto the first roll from said reservoir will be transferred to said second roll by said roller elements in the form of bands of ink, with the width of the bands of ink being determined by the settings of the contact pressures between the roller element outer surfaces and the roll outer surfaces.

2. Apparatus as in claim 1, wherein said roller elements comprise disk-shaped elements having an outer surface of a soft elastomeric material.

3. Apparatus as in claim 2, wherein said soft elastomeric material is a material having a durometer hardness of 10 to 30.

4. Apparatus as in claim 2, wherein said outer surfaces of said roller elements are bevelled surfaces.

5. Apparatus as in claim 1, wherein said roller elements comprise a composite structure having an inner core of hard elastomeric material and an outer core of soft elastomeric material.

6. Apparatus as in claim 5, wherein said hard elastomeric material has a durometer hardness of 70 to 90, and wherein said soft elastomeric material has a durometer hardness of 10 to 30.

7. Apparatus as in claim 6, wherein said hard material comprises nylon and wherein said soft material comprises polyurethane.

8. Apparatus as in claim 1, wherein said means mounting said roller elements in side-by-side relationship comprises means mounting each roller element at a projecting end of an elongated arm, and means mounting the opposite end of each arm at a respective side-by-side position adjacent another arm on a support extending longitudinally across and laterally spaced from said first and second rolls.

9. Apparatus as in claim 8, wherein said means mounting said opposite end of each said arm to said support comprises means adjustably fastening each said arm at a selected one of a plurality of locations axially of said arm.

10. Apparatus as in claim 9, wherein said means for adjustably fastening each said arm comprises said support having an upwardly extending bracket formed with a bore running perpendicularly to the longitudinal axis of said support, said arm being provided with an axially threaded bore at said opposite end, and a bolt extending through said bracket bore into threaded engagement into said arm bore.

11. Apparatus as in claim 10, wherein said means for adjustably fastenting each said arm further comprises means for guiding said arm axially over said support.

12. Apparatus as in claim 11, wherein said guiding means comprises each said arm being formed with depending, axially spaced locating lugs, and said support being formed along a top surface, at each side-by-side arm location along said support, with elongated guide channels aligned normal tothe longitudinal axis of the support, said guide channels being dimensioned to permit said lugs to be received therein for axial movement of the arm.

13. Apparatus as in claim 1, further comprising a leveling blade supported by said mounting means and extending across the width of said first roll, laterally spaced therefrom by a gap.

14. Apparatus as in claim 13, further comprising means for uniformly adjustably varying the spacing of said blade from said first roll.

15. Apparatus as in claim 1, wherein said second roll is a longitudinally vibratory roll whereby said ink is tanferred to said second roll in serpentine bands.

16. Liquid distributing apparatus, comprising:

a pair of parallel rotatable rolls laterally spaced across a gap;

a plurality of freely-rotatable rolling elements positioned in side-by-side parallel relationships and having radially-compressible resilient peripheral surfaces bridging the gap to be frictionally driven by said rolls; and means for individually selectively compressing said peripheral surfaces against said rolls to deform said surfaces to set the width of contact of the roller elements with said rolls, whereby the transfer of liquid from one roll to the other can be controllably affected.

17. Apparatus as in claim 16, wherein one of said rolls reciprocates longitudinally relative to said rolling elements; and wherein the rolling elements function to transfer liquid from the other roll to said one roll in sinusoidal bands.

18. Apparatus as in claim 17, wherein said roller elements are spaced at given intervals along the length of said one roll, and wherein the extent of relative reciprocation of said one roll is at least equal to said given interval spacing.

19. Apparatus as in claim 18, wherein said roller elements and said one roll are relatively dimensioned so that liquid tranferred by said roller elements during successive rotations of said one roll will be laid down in crisscrossing sinusoidal patterns.

20. In a liquid deposition system for lithographic, letterpress or flexographic printing and the like, having a fountain containing liquid, a slow speed rotatable fountain roll partially immersed in the liquid for picking up a film of the liquid, a high speed longitudinally vibrating distribution roll spaced laterally from and disposed parallel to said fountain roll, and other vibrating distribution rolls and form rolls disposed parallel to said distribution roll and leading onto a plate cylinder, the combination therewith of;

liquid transfer means comprising a plurality of roller elements having narrow annular surfaces of radially-compressible material which are positioned in the space between said fountain roll and said distribution roll and which are urged into compressed relationship against said rolls and into frictional contact therewith, for picking up liquid from said fountain roll and depositing the same onto said distribution roll in the form of a plurality of sinusoidal bands; and means for selectively individually varying the degree of compression of said elements against said fountain and distribution rolls to permit variation of the amount of ink transferred by said transfer members across the length of said distribution roll.

* * * * *